US010835907B2

(12) United States Patent
Mauchle et al.

(10) Patent No.: US 10,835,907 B2
(45) Date of Patent: Nov. 17, 2020

(54) METHOD FOR OPERATING A DENSE PHASE POWDER PUMP AND DENSE PHASE POWDER PUMP

(71) Applicant: GEMA SWITZERLAND GMBH, St. Gallen (CH)

(72) Inventors: Felix Mauchle, Abtwil (CH); Hanspeter Vieli, Goldach (CH)

(73) Assignee: GEMA SWITZERLAND GMBH, St. Gallen (CH)

( * ) Notice: Subject to any disclaimer, the term of this patent is extended or adjusted under 35 U.S.C. 154(b) by 259 days.

(21) Appl. No.: 15/574,130

(22) PCT Filed: May 3, 2016

(86) PCT No.: PCT/EP2016/059907
§ 371 (c)(1),
(2) Date: Nov. 14, 2017

(87) PCT Pub. No.: WO2016/192915
PCT Pub. Date: Dec. 8, 2016

(65) Prior Publication Data

US 2018/0147585 A1 May 31, 2018

(30) Foreign Application Priority Data

May 29, 2015 (DE) ..... 10 2015 108 492

(51) Int. Cl.
*B05B 7/14* (2006.01)
*F04B 43/02* (2006.01)

(52) U.S. Cl.
CPC ..... *B05B 7/1459* (2013.01); *B05B 7/1472* (2013.01); *F04B 43/02* (2013.01);
(Continued)

(58) Field of Classification Search
CPC . B05B 7/1459; B05B 7/1472; F04B 2201/06; F04B 2201/06011; F04B 2201/06012; F04B 43/02
(Continued)

(56) References Cited

U.S. PATENT DOCUMENTS 7,287,964 B2 * 10/2007 Sanwald ..... B05B 7/1459 417/395
2005/0126476 A1 * 6/2005 Shutic ..... B05B 5/032 118/308
(Continued)

FOREIGN PATENT DOCUMENTS

CN 103687673 A 3/2014
CN 104394999 A 3/2015
(Continued)

OTHER PUBLICATIONS

German Office Action, for German Patent Application No. 102015108492.9, dated Feb. 3, 2016, 6 pages.
(Continued)

*Primary Examiner* — Connor J Tremarche
(74) *Attorney, Agent, or Firm* — Kinney & Lange, P.A.

(57) ABSTRACT

The invention relates to a dense phase powder pump and a method for operating a dense phase powder pump in a powder-conveying mode. In order, in a simple manner, to prevent or at least reduce powder accumulations and clogging with powder, in particular on the powder inlet side of the powder conveying chamber of the dense phase powder pump, and thus in the region of the powder inlet valves, according to the invention, during a predefined or specified time period in at least one output phase and preferably at the end time of the output phase of a powder cycle, at least one of the following conditions exists: i) the powder inlet valve of the dense phase powder pump is open; ii) the powder outlet valve of the dense phase powder pump is closed;
(Continued)

and/or iii) the application of an overpressure to the powder conveying chamber of the dense phase powder pump is interrupted.

14 Claims, 2 Drawing Sheets

(52) U.S. Cl.
CPC . *F04B 2201/06* (2013.01); *F04B 2201/06011* (2013.01); *F04B 2201/06012* (2013.01)

(58) Field of Classification Search
USPC ..... 417/316
See application file for complete search history.

(56) References Cited

U.S. PATENT DOCUMENTS

| | | | | |
|---|---|---|---|---|
| 2005/0178325 | A1* | 8/2005 | Herre | B05B 7/1459 118/308 |
| 2006/0115763 | A1* | 6/2006 | Malachowski | B01F 13/02 430/137.1 |
| 2006/0159565 | A1* | 7/2006 | Sanwald | B05B 7/1459 417/395 |
| 2010/0221421 | A1* | 9/2010 | Mauchle | B05B 7/1459 427/180 |
| 2016/0052001 | A1* | 2/2016 | Pravert | F04F 5/14 137/565.11 |

FOREIGN PATENT DOCUMENTS

| | | | |
|---|---|---|---|
| DE | 19611533 | A1 | 9/1997 |
| DE | 102007045330 | A1 | 4/2009 |
| DE | 102007046806 | A1 | 4/2009 |
| DE | 102007048520 | A1 | 4/2009 |
| DE | 102012210439 | A1 | 12/2013 |
| DE | 102013205895 | A1 | 10/2014 |
| DE | 102013211536 | A1 | 12/2014 |
| DE | 102013211550 | A1 | 12/2014 |
| EP | 1437178 | A2 | 7/2004 |
| EP | 1566352 | A2 | 8/2005 |

OTHER PUBLICATIONS

International Preliminary Report on Patentability, for PCT Patent Application No. PCT/EP2016/059907, dated Oct. 17, 2017, 4 pages.
International Search Report & Written Opinion, for PCT Patent Application No. PCT/EP2016/059907, dated Jul. 21, 2016, 10 pages.
International Preliminary Report on Patentability, for PCT Patent Application No. PCT/EP2016/059907, dated Oct. 17, 2017, 15 pages.
Preliminary Examination Written Opinion, published by notification in Patent Online Gazette dated May 12, 2020 for corresponding Brazilian Application No. 112017025101, 6 pages.
Patent Online Gazette of Brazilian Patent Office, No. 2575, May 12, 2020, including Notice of Preliminary Examination of corresponding Brazilian Application No. 112017025101 on p. 451 (900 pages total).

* cited by examiner

METHOD FOR OPERATING A DENSE PHASE POWDER PUMP AND DENSE PHASE POWDER PUMP

BACKGROUND

The present invention relates to a method for operating a dense phase powder pump in a powder-conveying mode as well as a corresponding dense phase powder pump.

In the powder-conveying mode, the dense phase powder pump is in particular designed to convey powder, in particular coating powder, from a first powder reservoir to a second powder reservoir arranged downstream of the dense phase powder pump or a powder spray-coating gun or similar device for spray coating powder arranged downstream of the dense phase powder pump.

To that end, the dense phase powder pump comprises at least one, preferably exactly one, powder conveying chamber having a powder inlet and a powder outlet, wherein a powder inlet valve is allocated to the powder inlet and a powder outlet valve is allocated to the powder outlet, and wherein the powder conveying chamber comprises at least one air exchange opening for alternatingly pressurizing the powder chamber with an overpressure (for supplying compressed conveying air) or an underpressure (for suctioning powder). In the powder-conveying mode of the dense phase powder pump, powder, in particular coating powder, is alternatingly suctioned into the powder conveying chamber from a first powder reservoir during an intake phase and, during a subsequent delivery phase, the powder previously suctioned into the powder conveying chamber is expelled into a second powder reservoir arranged downstream of the dense phase powder pump or to a powder-spraying device arranged downstream of the dense phase powder pump. During the intake phase, the powder inlet valve is at least temporarily opened and the powder outlet valve at least temporarily closed while the powder conveying chamber is at least temporarily subjected to underpressure. During the delivery phase, the powder inlet valve is at least temporarily closed and the powder outlet valve at least temporarily opened while the powder conveying chamber is at least temporarily subjected to overpressure in order to supply at least a part of the compressed conveying air needed to convey the powder into the powder path via the powder conveying chamber.

Dense phase powder pumps having this mode of operation are at least in principle known from the prior art.

For example, printed publication EP 1 551 558 A1 relates to a dense phase powder pump having a first powder conveying chamber and a second powder conveying chamber arranged parallel to the first powder conveying chamber. The two powder conveying chambers of this known prior art dense phase powder pump are each limited both on the intake side as well as on the delivery side by a mechanically operated pinch valve arrangement.

In detail, it is thereby provided for the powder hoses connected to the powder conveying chambers in the dense phase powder pump's intake side region or delivery side region respectively of the to be able to be deformed by a mechanically operated piston in order to pinch off or respectively open the hose section as needed. Each powder conveying chamber of this known prior art dense phase powder pump is associated with a filter hose which limits the circumference of the respective powder conveying chamber. The filter hose is previous to air but not, however, to coating powder and is surrounded by an annular chamber which can alternately be connected to an underpressure or compressed air. Coating powder can thus be alternately suctioned into each powder conveying chamber or can be expelled from a respective powder conveying chamber by means of compressed air. The powder conveying chambers arranged parallel to each other are operated in phase opposition, meaning that one of the two powder conveying chambers suctions in coating powder through the powder inlet of the dense phase powder pump while the other of the two powder conveying chambers expels a portion of coating powder previously drawn into the powder conveying chamber via the powder outlet of the dense phase powder pump.

Dense phase powder pumps having multiple, in particular two, parallel-connected powder conveying chambers are also known from the WO 2005/005060 A2, DE 199 59 473 A1 and EP 1 752 399 A1 printed publications.

Utilizing dense phase powder pumps to convey coating powder to respective devices for spray coating powder, such as in particular spray-coating guns, is known from the DE 196 11 533 B4, WO 2004/087331 A1 and EP 1 566 352 A2 printed publications.

Before the use of dense phase powder pumps for conveying coating powder was known, powder pumps designed as injectors were used, these also still being used today for conveying coating powder. In contrast to dense phase powder pumps of the type specified at the outset, however, powder pumps designed as injectors have the disadvantage of these powder pumps designed as injectors usually only being able to convey a relatively small volume of coating powder per unit of time.

Dense phase powder pumps of the type specified at the outset have insofar become generally accepted in practice, in particular for applications in which a relatively large volume of coating powder is to be conveyed per unit of time.

The amount of powder conveyed by a dense phase powder pump per unit of time is in particular dependent on the size (volume) of the conveying chamber, on the frequency at which coating powder is suctioned into and then expelled again from the conveying chamber, on the strength of the vacuum to which the powder conveying chamber is subjected in order to suction powder into said powder conveying chamber from a powder reservoir during an intake phase, on the length of time the powder inlet valve is open during the intake phase (suction cycle part), and on the flow resistances in the powder lines upstream and in particular downstream of the dense phase powder pump. The flow resistances are in particular dependent on the length and the internal cross section of the powder lines, generally powder hoses.

The compressed conveying air introduced into the powder conveyance path via the powder conveying chamber of the dense phase powder pump particularly during the delivery phase mixes only minimally with the powder to be conveyed, in particular coating powder, and pushes the powder ahead of itself out of the powder conveying chamber through the powder outlet valve.

It has been seen in practical use that a dense phase powder pump, as is known for example from printed publication EP 1 551 558 A1, has a tendency to clog in the powder-conveying mode. This particularly pertains to the powder intake side of the dense phase powder pump and the powder inlet valve provided there.

SUMMARY

The present disclosure solves in simple manner the task of preventing or at least reducing powder accumulations and powder clogs in a dense phase powder pump of the type cited at the outset during the powder-conveying mode, particularly at the powder intake side of the dense phase powder pump's powder conveying chamber. This is to particularly apply to those types of powder which have a tendency to clump and/or adhere during conveyance.

The present disclosure solves this task by means of a method for operating a dense phase powder pump and, by means of a dense phase powder pump as disclosed herein.

According thereto, in particular proposed is a method for operating a dense phase powder pump in the powder-conveying mode, wherein the dense phase powder pump comprises at least one and preferably exactly one powder conveying chamber having a powder inlet and a powder outlet, whereby a powder inlet valve is allocated to the powder inlet and a powder outlet valve is allocated to the powder outlet. The powder conveying chamber comprises at least one air exchange opening for alternatingly pressurizing the powder conveying chamber with an overpressure (during a delivery phase) or an underpressure (during an intake phase). During the intake phase of the powder-conveying mode, powder, in particular coating powder, is suctioned into the powder conveying chamber from a first powder reservoir and, during a delivery phase preferably immediately subsequent the intake phase, the powder previously drawn in is expelled into a second powder reservoir arranged downstream of the dense phase powder pump or to a powder-spraying device arranged downstream of the dense phase powder pump.

During the intake phase, the powder inlet valve at the powder inlet of the powder conveying chamber is at least temporarily opened and the powder outlet valve at the powder outlet of the powder conveying chamber is at least temporarily closed while the powder conveying chamber is at least temporarily subjected to underpressure in order to thereby enable powder to be suctioned out of the first powder reservoir. On the other hand, during the delivery phase, the powder inlet valve at the powder inlet of the powder conveying chamber is at least temporarily closed and the powder outlet valve at the powder outlet of the powder conveying chamber is at least temporarily opened while the powder conveying chamber is at least temporarily subjected to overpressure in order to thereby expel the amount of powder previously drawn into the powder conveying chamber via the powder outlet of the powder conveying chamber.

In order to be able to effectively prevent a detrimental and thus unwanted accumulation of powder (powder aggregation) and thereby potentially accompanying powder blockages during the powder-conveying mode of the dense phase powder pump, particularly at the powder inlet valve of the powder conveying chamber, the present disclosure provides for at least one of the following conditions during a predefined or definable period of time in at least one delivery phase of a plurality of pump cycles, and preferably at the end of a respective delivery phase:

i) the powder inlet valve is open;

ii) the powder outlet valve is closed; and/or iii) the application of overpressure to the powder conveying chamber is interrupted.

Doing so thus enables cleaning and/or backwashing of the suction region of the dense phase powder pump during the delivery phase, and in particular at the end of the delivery phase. In particular, the actuating of the powder inlet valve and/or powder outlet valve ensures that no powder or only a very small amount of powder can deposit in a suction region of the dense phase powder pump since the valve actuation also gives momentum to the powder and thus prevents an accumulation of powder particles.

When, for example, compressed conveying air is also introduced into the powder conveying chamber in addition to a valve actuation (by subjecting the powder conveying chamber to a corresponding overpressure), this can achieve the back-washing of any powder particles which may be present at the powder intake side of the powder inlet valve back into the powder supply line (powder suction line). Doing so thereby even better prevents or at least reduces a powder aggregation and accompanying clogging of, in particular, the powder inlet valve.

When only the powder inlet valve is opened (condition i) during the predefined or definable delivery phase period, which is preferably at the end of the delivery phase, a "gentle" backwashing occurs due to the system counterpressure. The valve actuation in particular also effectively prevents an accumulation and aggregation of powder particles.

When, preferably additionally thereto, the powder outlet valve is at least temporarily closed during the predefined or definable period, a redirecting of the compressed conveying air introduced into the powder conveying chamber during the delivery phase occurs due to the application of overpressure. This intensifies the backwashing and thus results in an improved cleaning effect.

Preferably, the time period during which at least one of the cited conditions i) to iii) exists is variable and in particular individually and independently variable for all conditions i) to iii). Thus, correspondingly varying the time periods assigned to the conditions i) to iii) increases the intensity of the action of the respective conditions. This enables the powder conveying method to be individually adapted to different types of powder.

Advantageous further developments of the method for operating a dense phase powder pump in the powder-conveying mode are also disclosed herein.

The present disclosure further relates to a dense phase powder pump for conveying coating powder from a first powder reservoir to a downstream-arranged second powder reservoir or to a downstream-arranged powder spray-coating gun or similar device for spray coating powder. The dense phase powder pump comprises at least one, and preferably exactly one single, powder conveying chamber having a powder inlet and a powder outlet, wherein a powder inlet valve is allocated to the powder inlet and a powder outlet valve is allocated to the powder outlet. The powder conveying chamber of the dense phase powder pump comprises at least one air exchange opening, by means of which the powder conveying chamber can be alternately pressurized with an underpressure or an overpressure. A control device is moreover provided which is designed to control the powder inlet valve, the powder outlet valve and/or a device for applying an underpressure or respectively an overpressure to the powder conveying chamber such that the powder conveying method according to the present disclosure is or can be realized.

Preferably, the powder outlet and the powder outlet valve, or respectively the powder inlet and the powder inlet valve of the single powder conveying chamber or of each powder conveying chamber in the dense phase powder pump is arranged such that its powder passageway extends in the chamber's longitudinal direction, preferably axially to the chamber center line.

The powder inlet valve and the powder outlet valve employed in accordance with the present disclosure are preferably pinch valves. Along with same, the valve channel is formed by a flexible, elastic hose which can be radially compressed to close the valve, either by a mechanical element or by the pressure of compressed air in a pneumatics chamber surrounding the exterior of the hose.

According to an additional aspect of the present disclosure, it is provided for the method to comprise the method step of providing a dense phase powder pump of the previously cited type and the method step of performing a specific operating cycle, wherein said specific operating cycle encompasses the following cycle steps:

Generating an underpressure in the preferably single powder conveying chamber of the dense phase powder pump for suctioning coating powder into the powder conveying chamber through an opened powder inlet valve of the dense phase powder pump while the powder outlet valve of the dense phase powder pump is closed;

Closing the powder inlet valve and opening the powder outlet valve;

Introducing compressed gas into the powder conveying chamber for expelling the coating powder from the powder conveying chamber through the open powder outlet valve while the powder inlet valve is closed; and Closing the powder outlet valve and opening the powder inlet valve.

According to the present disclosure, the method provides for additional compressed conveying air to be fed as supplemental compressed air into the powder path at least at one point downstream of the powder outlet valve during cycle step a) or during the change from cycle step d) to cycle step a).

The present disclosure also relates to a powder spray-coating apparatus having a dense phase powder pump according to the present disclosure.

According to a further disclosed concept, at least one flow resistance is arranged in the powder flow path upstream or downstream of the dense phase powder pump, preferably a flow restrictor which is variable in terms of flow resistance. One advantage of this inventive concept is that the dense phase powder pump can also convey small volumes of powder flow per unit of time in relatively good compliance with a desired value. The reason for this is that flow resistance reduces the volume of powder flow per unit of time even when the volume of the compressed conveying air flow per unit of time is at such a high value as to thereby ensure powder conveyance in the dense phase powder pump and downstream of same without disadvantageous large-scale powder deposits developing in the powder path.

BRIEF DESCRIPTION OF THE DRAWINGS

The following will make reference to the accompanying drawings in describing a preferential example embodiment.

The figures show.

DETAILED DESCRIPTION

Figure 1:
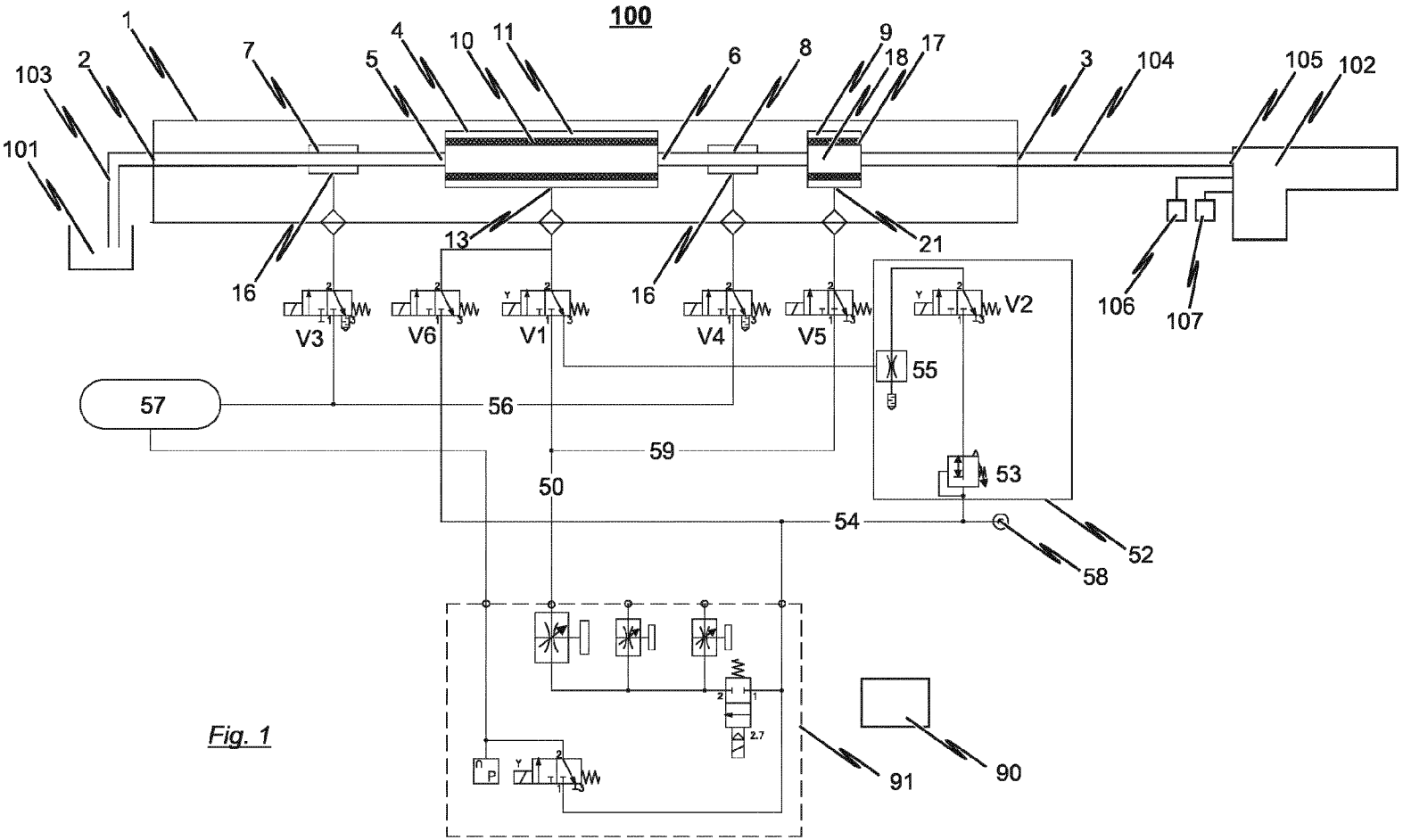
FIG. 1 a longitudinal section along the powder path through an example embodiment of the dense phase powder pump according to the invention.
Figure 2:
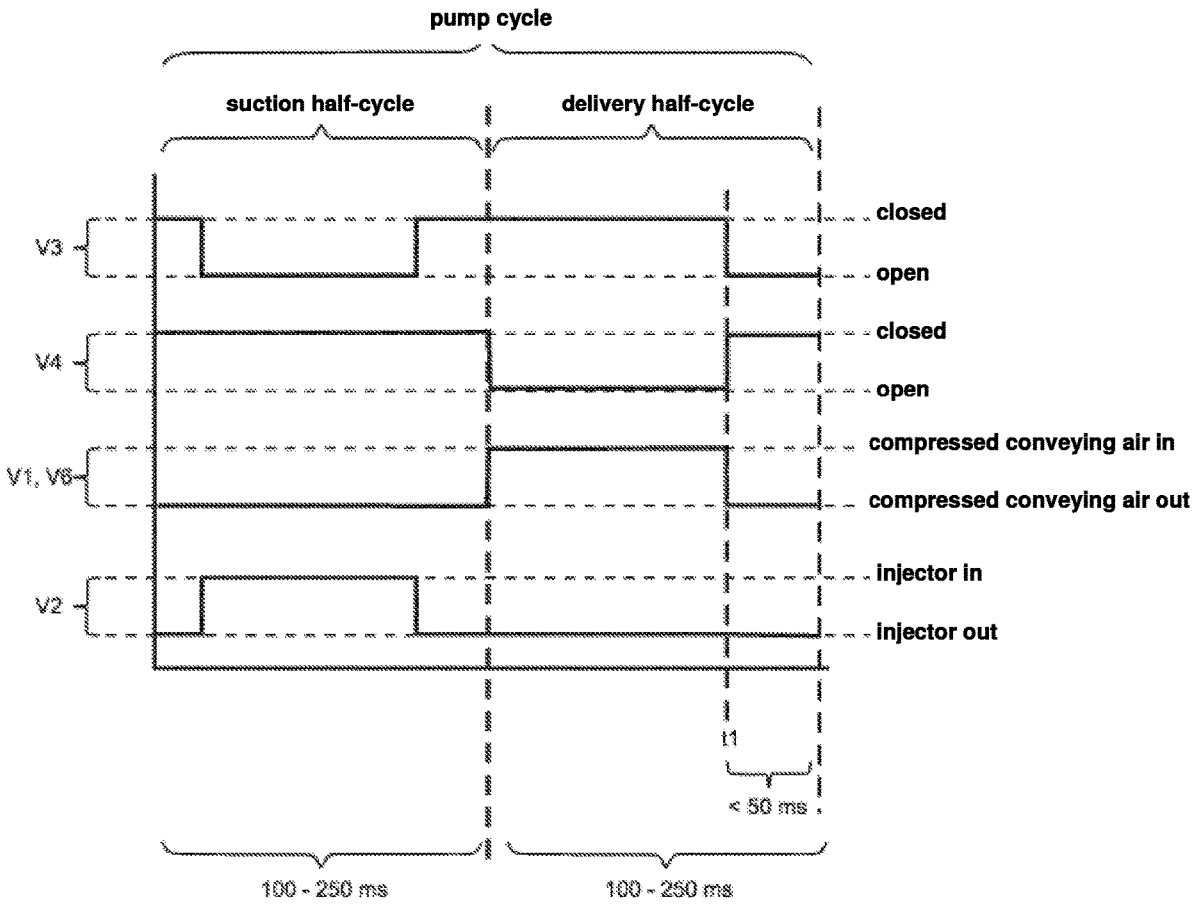
FIG. 2 a time-based flow chart to illustrate an example embodiment of the powder conveying method according to the invention.

The following will reference the representations provided in FIGS. 1 and 2 in describing example embodiments of the dense phase powder pump and the powder conveying method respectively.

In detail, FIG. 1 schematically depicts an example embodiment of a powder spray-coating apparatus 100 which makes use of an embodiment of the dense phase powder pump 1 for conveying powder (here: coating powder) from a first powder reservoir 101 to a powder spray-coating gun 102 arranged downstream of the dense phase powder pump 1. In place of the powder spray-coating gun 102, another mechanism for spray coating powder onto an object to be coated can also be used, as can a second powder reservoir.

As FIG. 1 schematically depicts, the example embodiment of the dense phase powder pump 1 used therein comprises a powder inlet 2 which is fluidly connected or connectable to a first powder reservoir 101 by means of a powder line 103, in particular by means of a suction hose or the like. A powder outlet 3 is provided at the opposite end section of the dense phase powder pump 1 which is connected or connectable to a coating powder inlet 105 of a powder spray-coating gun 102 by means of a powder line 104, in particular by means of a powder hose.

Specifically, both the powder inlet 2 as well as the powder outlet 3 of the dense phase powder pump 1 are each formed as hose connectors in the example embodiment schematically depicted in FIG. 1, to which the respective powder line 103/104 can be attached and fixed by means of a hose clamp. However, other embodiments are of course also conceivable for the powder inlet 2 and/or the powder outlet 3.

The dense phase powder pump 1 shown schematically in FIG. 1 is designed as a single-chamber dense phase powder pump, whereby only one single powder conveying chamber 4 is provided for conveying coating powder from the first powder reservoir 101 to the powder spray-coating gun 102 or, respectively, to another device for spray coating objects or to a further powder reservoir.

However, the invention is not limited to such a dense phase powder pump designed as a single-chamber dense phase powder pump. Rather, the teachings according to the present disclosure are also applicable to a multi-chamber dense phase powder pump such as, for instance, a dense phase powder pump as known from the EP 1 551 558 A1 printed publication.

In the example embodiment of the dense phase powder pump 1 according to FIG. 1, the (single) powder conveying chamber 4 has a powder inlet 5 at a first end section pointing toward the powder inlet 2 of the dense phase powder pump 1. The powder conveying chamber 4 further has a powder outlet 6 pointing toward the powder outlet 3 of dense phase powder pump 1. A powder inlet valve 7 is arranged directly adjacent the powder inlet 5 of the powder conveying chamber 4 and namely such that the powder inlet valve 7 lies between the powder inlet 5 of the powder conveying chamber 4 and the powder inlet 2 of the dense phase powder pump 1. Similarly, a powder outlet valve 8 is arranged directly adjacent the powder outlet 6 of the powder conveying chamber 4.

In contrast to the powder inlet region of the dense phase powder pump 1, however, the powder outlet valve 8 at the powder outlet region of the dense phase powder pump 1 is not arranged directly between the powder outlet 6 of the powder conveying chamber and the powder outlet 3 of the dense phase powder pump 1; instead, a supplemental compressed air intake device 9 is arranged between the powder outlet valve 8 and the powder outlet 3 of the dense phase powder pump 1.

As will be described in greater detail below, this supplemental compressed air intake device 9 serves to supply additional compressed conveying air into the powder path between the powder outlet valve 8 and the powder outlet 3 of the dense phase powder pump 1 when needed.

It is to be pointed out here that it is not absolutely imperative for any supplemental compressed air intake device 9 to be provided at all or, respectively, that any supplemental compressed air intake device 9 which is provided to be arranged between the powder outlet valve 8 and the powder outlet 3 of the dense phase powder pump 1.

Should, however, a supplemental compressed air intake device 9 be provided, it is to be noted that the effects able to be achieved with said supplemental compressed air intake device 9, which will be described in greater detail below, can then also be realized when the supplemental compressed air intake device 9 is arranged downstream of the powder outlet 3 of the dense phase powder pump 1.

Although not depicted in FIG. 1, a further valve, particularly a pinch valve, is provided in advantageous implementations of the dense phase powder pump 1 between the supplemental compressed air intake device 9 and the powder outlet 3 of the dense phase powder pump 1, same then assuming the function of the powder outlet valve since it is arranged directly at the powder outlet 3 of the dense phase powder pump 1.

However, as can in particular be seen from the representation provided in FIG. 1, the powder inlet 2 of the dense phase powder pump 1, the powder inlet valve 7, the powder inlet 5 of the powder conveying chamber 4, the powder conveying chamber 4, the powder outlet 6 of the powder conveying chamber 4, the supplemental compressed air intake device 9 (as provided in this example embodiment) as well as the powder outlet 3 of the dense phase powder pump 1 all lie along a common longitudinal axis.

In other words, in the example embodiment of the dense phase powder pump 1 depicted schematically in FIG. 1, the powder inlet 2 of the dense phase powder pump 1 is provided at the opposite end of the powder outlet 3 of the dense phase powder pump 1.

The following will describe the structure and the functioning of in particular the single powder conveying chamber 4 of the example embodiment of the dense phase powder pump 1 depicted schematically in FIG. 1 in greater detail.

As can be noted from the longitudinal section of FIG. 1, between its powder inlet 5 and its powder outlet 6, the powder conveying chamber 4 is formed by the cylindrical wall of a hose-like filter 10 which is previous to air albeit not to coating powder and can consist for example of sintered material. The filter 10 configured as a filter hose is surrounded by an intermediate chamber 11, the exterior of which is limited by a housing 12 of the powder conveying chamber 4.

An air exchange opening 13, which is fluidly connected to a control valve VI, opens through the housing 12. The powder conveying chamber 4 can be alternately supplied with compressed conveying air from a compressed air supply line 50 or subject to a vacuum, respectively an underpressure, of a vacuum source 52 by means of the control valve VI.

In the embodiment of the powder spray-coating apparatus 100 depicted schematically in FIG. 1, the vacuum source 52 comprises an injector 55 which is fed compressed injector air by a compressed air supply line 54 or respectively a compressed air source 58, for example by way of a pressure regulator 53 and a further control valve V2.

In order to be able to suction powder, in particular coating powder, out of the first powder reservoir 101 through the powder inlet 2 of the dense phase powder pump 1 into the powder conveying chamber 4 during an intake phase of the dense phase powder pump 1, the powder outlet valve 8 arranged at the powder outlet 6 of the powder conveying chamber 4 is closed and the powder inlet valve 7 arranged between the powder inlet 2 of the dense phase powder pump 1 and the powder inlet 5 of the powder conveying chamber 4 is opened.

At the same time, upon the actuating of the powder outlet valve 8 and the powder inlet valve 7, or directly thereafter, the powder conveying chamber 4 is connected to the vacuum source 52 via the control valve VI and the associated air exchange opening 13 so that there is an underpressure in the powder conveying chamber 4 and coating powder can be suctioned in from the first powder reservoir 101.

After the coating powder has been suctioned into the powder conveying chamber 4, a change ensues from the intake phase to the delivery phase of powder, in particular coating powder, from the conveying chamber 4. To that end, the powder inlet valve 7 is closed and the powder outlet valve 8 opened while the control valve VI provides a fluid connection between the air exchange opening 13 and the compressed air supply line 50 so that the portion of powder previously drawn into the powder conveying chamber 4 during the intake phase is expelled through the open powder outlet valve 8 by means of the compressed conveying air supplied via the air exchange opening 13.

According to the present disclosure, a control device 90 is provided which is designed to control, pursuant to a predefined or definable program sequence, the valve V3 associated with the powder inlet valve 7, the valve V4 associated with the powder outlet valve 8, valves VI and V6 associated with the powder conveying chamber 4, the valve V5 associated with the overpressure air intake device 9 and/or the valve V2 associated with the injector 55 as for example provided in the dense phase powder pump 1 as schematically depicted in FIG. 1.

One example embodiment of such a program sequence will be described further below in conjunction with the flow chart depicted in FIG. 2.

According to a further advantageous aspect of the present disclosure, the control device 90 is designed such that the pulse frequency of the additional compressed air supplied to the supplemental compressed air intake device 9 can be varied as a function of the powder dispensing frequency of the powder conveying chamber 4 in at least one of the following ways: e.g. manually adjustable and/or preferably automatically controllable or preferably variable. The supplemental compressed air pulse frequency can thereby be advantageously increased with increasing powder-dispensing frequency and reduced with decreasing powder-dispensing frequency.

According to a further preferential embodiment of the present disclosure, the control device 90 can be advantageously designed so as to be able to vary the volume of the additional compressed air flowing through the supplemental compressed air intake device 9 per unit of time as a function of the volume of conveyed powder in at least one of the following ways: e.g. manually adjustable and/or preferably automatically controllable or preferably variable.

The control device 90 of the dense phase powder pump 1, respectively the powder spray-coating apparatus 100, can be designed for the cited setting of the supplemental compressed air pulse frequency or the cited setting of the supplemental compressed air volume, or for both settings. The control device 90 can contain all the control elements or two or more control devices can be provided. If manually setting the supplemental compressed air pulse frequency or the supplemental compressed air flow volume is desired, a manual adjusting element can in each case be provided for this purpose.

As already indicated, the powder inlet valve 7 and the powder outlet valve 8 of the dense phase powder pump 1 are each preferably configured as a pinch valve since less coating powder can accumulate in pinch valves than in other types of valves and because any powder deposits can be easily cleaned by the air flowing through them.

Pinch valves are valves controllable by means of compressed air or by means of underpressure. In principle, however, other controllable valves can also be used. There is furthermore also the possibility of using automatic valves instead of controllable valves, for example ball valves or flap valves, which are automatically controlled by the pressure difference between the valve inlet side and the valve outlet side and thus by the overpressure and underpressure prevailing in the powder conveying chamber 4.

The previously cited control device 90, schematically indicated in FIG. 1, is used to control the operation of the dense phase powder pump 1. The control device 90 is in particular designed to applicably control the individual controllable components of the dense phase powder pump 1, particularly control valves VI, V2, V3, V4 and V5, and coordinate their operation.

In the embodiments of the dense phase powder pump 1, respectively powder spray-coating apparatus 100, depicted schematically in FIG. 1, a still further control valve V6 is provided, by means of which the powder conveying chamber 4 can be subjected to high pressure during a cleaning cycle of the dense phase powder pump 1.

The control device 90 is preferably designed so as to open the control valve V4 in preparation of the intake phase of the powder conveying chamber 4 so that the compressed air in the pressure accumulator 57 or provided by the compressed air source 58 respectively is directed into the pressure chamber of the powder outlet valve 8 designed as a pinch valve via the compressed air supply line 56 and the air exchange opening 16. As a result, the flexible elastic hose of the powder outlet valve 8 designed as a pinch valve is squeezed, in consequence of which the powder path through the powder outlet valve 8 provided by the flexible elastic hose is closed.

With the closing of the powder outlet valve 8, the air exchange opening 13 provided in the housing 12 of the powder conveying chamber 4 is fluidly connected to the vacuum source 52 by means of the control device 90 in order to generate an underpressure inside the powder conveying chamber 4 so that coating powder can be suctioned into the powder conveying chamber 4 via the powder inlet 2 of the dense phase powder pump 1 and the (opened) powder inlet valve 7 as well as the powder inlet 5 of the powder conveying chamber 4.

According to preferential embodiments of the present disclosure, to initiate the intake phase of the dense phase powder pump 1, the control device 90 produces a control signal to generate the underpressure in the powder conveying chamber 4, at the earliest simultaneously to or preferably at a predetermined time lag after a control signal to open the powder inlet valve 7, so that the underpressure begins to be established in the powder conveying chamber 4 at the earliest simultaneously to the powder inlet valve 7 opening, preferably by the cited predetermined time lag after the powder inlet valve 7 opens. The predetermined time lag is preferably in the range of between 0 ms and 50 ms in a conveying cycle of the powder conveying chamber 4 of approximately 200 ms.

This thereby achieves the underpressure in the powder conveying chamber 4 less strongly counteracting an opening movement of the powder inlet valve 7, in particular when same is a pinch valve, at least at the point in time at which the opening movement of the powder inlet valve 7 begins than is the case in the prior art, where a drop in pressure usually occurs in the respective powder conveying chamber even before the powder inlet valve opens.

The control valve V3 is thereafter fluidly connected to the compressed air supply line 56, in consequence of which an overpressure is generated in the pressure chamber 15.1 of the powder inlet valve 7 designed as a pinch valve which effects a squeezing of the flexible elastic hose of the powder inlet valve 7 designed as a pinch valve 7, thereby closing the powder inlet valve 7.

Control valve V4 depressurizes the air exchange opening 17 of the pressure chamber of the powder outlet valve 8 designed as a pinch valve 8 or deaerates the pressure chamber respectively. Due to the elasticity of the hose of the powder outlet valve 8 designed as a pinch valve, it then immediately switches over into its opened state.

At this moment or immediately thereafter, control valve VI is switched by means of the control device 90 such that the air exchange opening 13 configured in the housing 12 of the powder conveying chamber 4 is fluidly connected to the compressed air source 58. The compressed air then flows into the powder conveying chamber 4 via the compressed air supply line 50, the control valve VI, the intermediate chamber 11, and the filter element 10 and expels the portion of powder which was previously drawn in out through the powder outlet 6 of the powder conveying chamber 4.

With the help of the compressed conveying air fed into the powder conveying chamber 4 via the compressed air supply line 50, the portion of powder is further conveyed through the open powder outlet valve 8, the filter hose duct 18 of the supplemental compressed air intake device 9 and the powder outlet 3 of the dense phase powder pump 1.

The control device 90 is in particular also designed to feed additional compressed conveying air into the powder path between the powder outlet valve 8 and the powder outlet 3 of the dense phase powder pump 1 via the supplemental compressed air intake device 9 as pulses. Always feeding the additional compressed conveying air fed into the powder path in pulsed manner via the supplemental compressed air intake device 9 over the entire period or over a predetermined or predefinable partial period of the intake phase of the powder conveying chamber 4 has hereby proven to be an advantage in order to thereby effectively prevent and/or minimize pulsations in the flow of powder expelled from the dense phase powder pump 1.

Specifically, the control device 90 is then designed to this end to always fluidly connect the air exchange opening 21 of the compressed air chamber 19 of the supplemental compressed air intake device 9 to the compressed air source 58 whenever the powder outlet valve 8 is closed.

In order to effectively prevent an aggregation of powder and a potential accompanying blockage of the powder inlet valve 7, or at least be able to reduce the risk of a blockage particularly in the case of powder types which tend to clump or clog during powder conveyance (in the powder-conveying mode of the dense phase powder pump 1), the example embodiment of the dense phase powder pump 1 according to the present disclosure provides for at least one of the following conditions during a predefined or definable period of time in at least one delivery phase of a plurality of pump cycles, and preferably at the end of a respective delivery phase:

the powder inlet valve 7 is open;

the powder outlet valve 8 is closed; and/or the application of overpressure to the powder conveying chamber 4 is interrupted.

Doing so thus enables a cleaning and/or backwashing of the suction region of the dense phase powder pump 1 during the delivery phase, and in particular at the end of the delivery phase. In particular, the actuating of the powder inlet valve 7 and/or powder outlet valve 8 ensures that no powder or only a very small amount of powder can deposit in a suction region of the dense phase powder pump 1 since the valve actuation also gives momentum to the powder and thus prevents an accumulation of powder particles.

When, for example, compressed conveying air is also introduced into the powder conveying chamber 4 in addition to a valve actuation (by subjecting the powder conveying chamber 4 to a corresponding overpressure 4), this can achieve the back-washing of any powder particles which may be present at the powder intake side of the powder inlet valve back into the powder supply line (powder suction line). Doing so thereby even better prevents or at least reduces a powder aggregation and accompanying clogging of, in particular, the powder inlet valve.

When only the powder inlet valve is opened (condition i) during the predefined or definable delivery phase period, which is preferably at the end of the delivery phase, a "gentle" backwashing occurs due to the system counterpressure. The valve actuation in particular also effectively prevents an accumulation and aggregation of powder particles.

When, preferably additionally thereto, the powder outlet valve is at least temporarily closed during the predefined or definable period, a redirecting of the compressed conveying air introduced into the powder conveying chamber during the delivery phase occurs due to the application of overpressure. This intensifies the backwashing and thus results in an improved cleaning effect.

The backwashing preferably occurs at the end of each delivery phase of coating powder from the powder conveying chamber 4. However, it is also conceivable in this context for the backwashing to not occur upon each delivery phase but instead only when needed or cyclically, in particular manually induced.

The following will reference the time-based flow chart according to FIG. 2 in describing in greater detail an example embodiment of the conveying method which can be realized for example employing the control device 90 of the embodiment of the dense phase powder pump 1 depicted schematically in FIG. 1.

In detail, the flow chart according to FIG. 2 schematically depicts how the valve V3 associated with the powder inlet valve 7, the valve V4 associated with the powder outlet valve 8, the valves VI and V6 associated with the powder conveying chamber 4, the valve V5 associated with the overpressure air intake device 9 and the valve V2 associated with the injector 55 can for example be controlled via a control device 90 of the phase powder pump 1 schematically depicted as an example in FIG. 1 in an example embodiment of the disclosed solution.

The flow chart thereby depicts a pump cycle consisting of an intake phase (suction half-cycle) and a subsequent delivery phase (delivery half-cycle).

In the example embodiment, the duration of the intake phase and the duration of the delivery phase are identical or substantially identical. However, selecting different duration lengths for the intake phase and the delivery phase is of course also conceivable.

In order to also prevent or at least reduce pulsations in the expelled flow of powder of a dense phase powder pump 1 which comprises—as FIG. 1 schematically indicates—only one single powder conveying chamber 4, the intake phase and the delivery phase should each preferably not last longer than 250 ms. Particularly provided for according to further developments of the invention is for the intake phase/delivery phase to respectively amount to 100 to 250 ms in total, preferably respectively 120 to 200 ms in total, and even further preferentially, respectively 160 to 180 ms in total.

To reduce the response time of the inventive dense phase powder pump 1 and thus increase its conveying frequency, one aspect of the present disclosure provides for the applying of an underpressure to the powder conveying chamber 4 during the intake phase of the powder conveying chamber at the earliest simultaneous to or preferably at a defined time lag after a control signal is generated to open the powder inlet valve arranged at the powder inlet of the powder conveying chamber so that the underpressure begins to be established in the powder conveying chamber 4 at the earliest simultaneously to the powder inlet valve opening, preferably, however, by the cited predetermined time lag after the powder inlet valve opens. The predetermined time lag is preferably in a range of between 0 ms and 50 ms in a conveying cycle of the powder conveying chamber (=pump cycle of the dense phase powder pump) of approximately 200 ms. This example does not, however, exclude the use of other delay periods and cycle times for the dense phase powder pump.

Because in advantageous implementations of the disclosed solution, an underpressure is not applied to the powder conveying chamber during the intake phase of the dense phase powder pump until the powder inlet valve is already opened or, respectively, at the earliest simultaneously to the powder inlet valve being opened, this can achieve the underpressure in the powder conveying chamber less strongly counteracting an opening movement of the powder inlet valve, in particular when same is designed as a pinch valve, at least at the point in time at which the opening movement of the powder inlet valve begins than is the case with solutions designed for known prior art dense phase powder pumps.

This delayed application of an underpressure to the powder conveying chamber is indicated in the first suction half-cycle (left side) of the FIG. 2 flow chart.

The right side of the FIG. 2 flow chart shows the delivery half-cycle of an example embodiment of the disclosed solution.

As FIG. 2 depicts as an example, during the delivery half-cycle (delivery phase), the powder inlet valve 7 is closed up until time point t1 and the powder outlet valve 8 is open while the powder conveying chamber 4 is subjected to overpressure and compressed conveying air is fed into the powder conveying chamber 4.

At time t1 in the embodiment of the dense phase powder pump depicted schematically in FIG. 1, the powder inlet valve 7 is then for example opened, the powder outlet valve 8 closed and the overpressure applied to the powder conveying chamber 4 (the supplying of compressed conveying air). So doing enables a cleaning of the suction region of the dense phase powder pump to occur at the end of the delivery phase. In particular, the actuating of the powder inlet valve 7 and powder outlet valve 8 ensures that no powder or only a very small amount of powder can deposit in a suction region of the dense phase powder pump 1 since the valve actuation also gives momentum to the powder and thus effectively prevents an accumulation and aggregation of powder particles.

When, for example, compressed conveying air is also introduced into the powder conveying chamber in addition to a valve actuation (by subjecting the powder conveying chamber to a corresponding overpressure), this can achieve the back-washing of any powder particles which may be present at the powder intake side of the powder inlet valve back into the powder supply line (powder suction line. Doing so thereby even better prevents or at least reduces a powder aggregation and accompanying clogging of, in particular, the powder inlet valve.

Although the powder inlet valve 7 is open, the powder outlet valve 8 is closed and the overpressure applied to the powder conveying chamber 4 is interrupted at the same time in the embodiment depicted in FIG. 2, this is not to be understood as a limitation. It is of course conceivable to select different respective time points for the opening of the powder inlet valve 7, the closing of the powder outlet valve 8 and/or the interrupting of the application of overpressure to the powder conveying chamber 4 at the end of the delivery phase.

Nor is it absolutely imperative for all of the cited conditions (powder inlet valve 7 is open; powder outlet valve 8 is closed; application of overpressure to the powder conveying chamber 4 is interrupted) to occur at the end of the delivery phase.

In accordance with preferential implementations of the disclosed solution, at least one of the cited conditions is initiated at a maximum of 50 ms and preferably at a maximum of 30 ms prior to the (time-based) end of the delivery half-cycle.

The invention is not limited to the example embodiments schematically depicted in the figures but rather yields from an integrated consideration of all the features disclosed herein in context.

The invention claimed is:

1. A method for operating a dense phase powder pump in a powder-conveying mode, wherein the dense phase powder pump comprises at least one powder conveying chamber having a powder inlet and a powder outlet, wherein a powder inlet valve is allocated to the powder inlet and a powder outlet valve is allocated to the powder outlet, and wherein the powder conveying chamber comprises at least one air exchange opening for alternatingly pressurizing the powder conveying chamber with underpressure or overpressure, wherein during an intake phase of the powder-conveying mode of the dense phase powder pump, powder, in particular coating powder, is suctioned into the powder conveying chamber from a first powder reservoir and during a subsequent delivery phase, the powder previously drawn in is expelled into a second powder reservoir arranged downstream of the dense phase powder pump or to a powder-spraying device arranged downstream of the dense phase powder pump, wherein during the intake phase, the powder inlet valve is at least temporarily opened and the powder outlet valve is at least temporarily closed while the powder conveying chamber is at least temporarily subjected to underpressure, wherein during the delivery phase, the powder inlet valve is at least temporarily closed and the powder outlet valve is at least temporarily opened while the powder conveying chamber is at least temporarily subjected to overpressure, and the delivery phase is defined by a start time when the powder inlet valve is closed, the powder outlet valve is opened, and the powder conveying chamber is subjected to overpressure, and by an end time when the powder inlet valve is opened, the powder outlet valve is closed, and the powder conveying chamber is no longer subjected to overpressure, and wherein at least one of the following conditions exists during a predefinable or definable period of time between the start time and the end time of at least one delivery phase of a plurality of pump cycles:

i) the powder inlet valve is open;

ii) the powder outlet valve is closed; and/or iii) the application of overpressure to the powder conveying chamber is interrupted.

2. The method according to claim 1, wherein at least one of the following conditions exists at the end of a respective delivery phase:

i) the powder inlet valve is open;

ii) the powder outlet valve is closed; and/or iii) the application of overpressure to the powder conveying chamber is interrupted.

3. The method according to claim 1, wherein all the conditions i) to iii) exist during the predefinable or defined time period between the start time and the end time of the delivery phase.

4. The method according to claim 1, wherein the intake phase and/or the delivery phase respectively last 100 to 250 ms in total.

5. The method according to claim 1, wherein a duration of the intake phase and a duration of the delivery phase are identical.

6. The method according to claim 1, wherein a duration of the intake phase and/or a duration of the delivery phase is/are variable.

7. The method according to claim 1, wherein a period of time during which at least one of the conditions i) to iii) exists amounts to a maximum of 50 ms.

8. The method according to claim 1, wherein a period of time during which at least one of the conditions i) to iii) exists is variable.

9. The method according to claim 1, wherein the powder inlet valve is closed for a first period of time during the intake phase, open for a second period of time subsequent the first period, and closed again for a third period of time subsequent the second period.

10. The method according to claim 9, wherein the first and/or third time period lasts for 10 to 50 ms; and/or wherein the second time period lasts for 80 to 150 ms.

11. The method according to claim 9, wherein the length of time of the first, second and/or third time period of the intake phase is/are variable.

12. The method according to claim 1, wherein the powder outlet valve is closed during the entire intake phase; and/or wherein underpressure is applied to the powder conveying chamber during the entire intake phase.

13. The method according to claim 1, wherein the dense phase powder pump further comprises a supplemental compressed air intake device which opens into the powder path at least at one point downstream of the powder outlet valve to supply supplemental compressed air as additional compressed conveying air, and wherein the method further comprises the following method steps:

the supplemental compressed air intake device at least intermittently feeding supplemental compressed air into the powder path during the intake phase as additional compressed conveying air; and the supplemental compressed air intake device not feeding any supplemental compressed air into the powder path as additional compressed conveying air during the entire delivery phase.

14. A dense phase powder pump for conveying powder from a first powder reservoir to a downstream-arranged second powder reservoir or to a downstream-arranged powder spray-coating gun or device for spraying powder, wherein the dense phase powder pump comprises at least one powder conveying chamber having a powder inlet and a powder outlet, wherein a powder inlet valve is allocated to the powder inlet and a powder outlet valve is allocated to the powder outlet, and wherein the powder conveying chamber comprises at least one air exchange opening for alternatingly pressurizing the powder conveying chamber with overpressure or underpressure, wherein the dense phase powder pump further comprises a control device designed to implement the method according to claim 1.

* * * * *